United States Patent [19]

Yoshino et al.

[11] 4,095,574

[45] Jun. 20, 1978

[54] MECHANICAL GOVERNOR FOR INTERNAL COMBUSTION ENGINE

[75] Inventors: Masao Yoshino; Koichi Mori, both of Higashimatsuyama, Japan

[73] Assignee: Diesel Kiki Co., Ltd., Tokyo, Japan

[21] Appl. No.: 750,321

[22] Filed: Dec. 13, 1976

[30] Foreign Application Priority Data

Dec. 15, 1975 Japan ..... 50-168144[U]

[51] Int. Cl.[2] ..... F02D 1/04

[52] U.S. Cl. ..... 123/140 R

[58] Field of Search ..... 123/140 R

[56] References Cited

U.S. PATENT DOCUMENTS

| | | | |
|---|---|---|---|
| 3,895,619 | 7/1975 | Potter | 123/140 R |
| 3,903,860 | 9/1975 | Maier | 123/140 R |
| 4,038,958 | 8/1977 | Susuki | 123/140 R |

FOREIGN PATENT DOCUMENTS

| | | | |
|---|---|---|---|
| 2,410,382 | 9/1974 | Germany | 123/140 R |

*Primary Examiner*—Charles J. Myhre
*Assistant Examiner*—Tony M. Argenbright
*Attorney, Agent, or Firm*—Sughrue, Rothwell, Mion, Zinn and Macpeak

[57] ABSTRACT

A mechanical governor for a Diesel construction vehicle engine includes a centrally pivoted torque lever 32 whose lower end is proximate a stop pin 33 on the lower end of a conventional main spring tension lever 9, and whose upper end is cammed against an adjustable torque spring 29 by an extension arm 19*a* integral with a conventional speed control lever 18 at low or partial load speed settings. This pivots the lower end of the torque lever 32 away from and out of engagement with the pin stop 33, whereby the torque spring 29 is inoperable and no additional engine slowdown is caused thereby. At full throttle or maximum load settings, however, the extension arm 19*a* releases the torque lever 32 and the torque spring 29 pivots the lower end of the arm into engagement with the pin stop 33. Thus, the added restraining force of the torque spring retards the speed increasing movement of the tension lever, to thereby provide the desired anti-stall delay during which the operator has time to back off or shift to a lower gear ratio.

3 Claims, 5 Drawing Figures

MECHANICAL GOVERNOR FOR INTERNAL COMBUSTION ENGINE

BACKGROUND OF THE INVENTION

This invention relates in general to a mechanical governor for an internal combustion engine, and more particularly to a cam shaft torque controlling device for an all-speed type of mechanical governor for a Diesel engine fuel injection pump in which the engine speed control range is set or determined by the position of a movable control lever.

As is well known, in existing governor assemblies, especially those for Diesel engines adapted to construction vehicles, speed control is implemented in the same manner for lower loads or lower torque ranges as it is for maximum load and torque conditions during a construction operation.

FIG. 3 shows a plot of engine rotation speed N versus the position of the injection pump control rod R, which represents the amount of load exerted on or torque exerted by the engine. The rotation speed $N_B$ and the corresponding position of the control rod $R_B$ for a maximum engine output under full load setting is plotted, as is a predetermined low rotation speed $N_C$, which is 50% lower than the rated speed, and the position of the control rod $R_C$ for a maximum engine output under full-load. In a conventional governor assembly, when the load is lower than $R_B$ speed control is effected as in an ordinal type of all-speed mechanical governor. If the load exceeds $R_B$, however, the control rod must be shifted a distance Q (from $R_B$ to $R_C$) in accordance with the speed deceleration curve from $N_B$ to $N_C$ in order to prevent the engine from suddenly stopping or stalling due to the increased (over capacity) load. This sharp speed slowdown alerts the operator to the overload, and enables him to back the machine off and/or shift to a lower gear ratio before the engine stalls. To implement this control function a torque spring is usually employed in the governor assembly. This presents a drawback, however, in that since the torque spring is operable or functioning at all times and for all load conditions, engine output shortages are unnecessarily caused thereby even during partial or reduced load operations.

SUMMARY OF THE INVENTION

It is therefore an object of the present invention to provide an improved torque control device for a mechanical governor which prevents engine output shortages during partial load operations, and in which the torque spring may be easily adjusted without affecting the functioning of the torque control mechanism.

Briefly, and in accordance with the present invention, the conventional torque spring assembly is eliminated and replaced by a centrally pivoted torque lever whose lower end is proximate a pin stop on the lower end of the conventional main spring tension lever, and whose upper end is cammed against a simplified, adjustable torque spring by an extension arm integral with the conventional speed control lever. With this arrangement, the lower end of the torque lever is pivoted away from and out of engagement with the pin stop at low or partial load speed settings, whereby the torque spring is inoperable and no additional engine slowdown is caused thereby. At full throttle or maximum load settings, however, the extension arm releases the torque lever and the torque spring pivots the lower end of the arm into engagement with the pin stop. Thus, the added restraining force of the torque spring retards the speed increasing movement of the tension lever, to thereby provide the desired anti-stall delay during which the operator has time to back off or shift to a lower gear ratio.

DETAILED DESCRIPTION OF THE PREFERRED EMBODIMENTS

Figure 1:
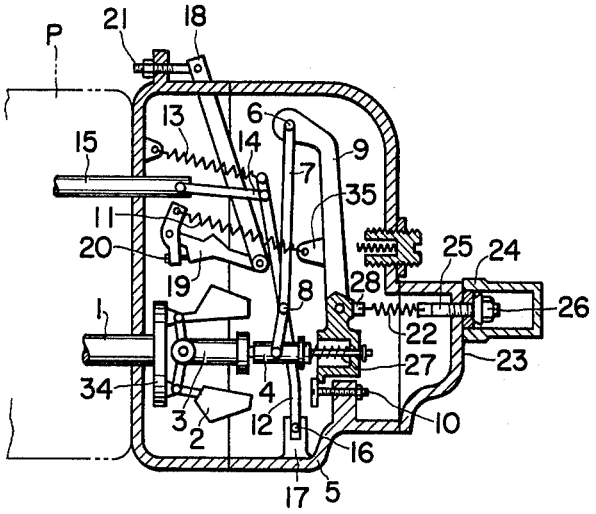
FIG. 1 PRIOR ART
FIG. 1 is a schematic sectional view of a centrifugal type mechanical governor mechanism employing a conventional torque control device.

Referring first to a conventional governor mechanism as shown in FIG. 1, the cam shaft 1 of a fuel injection pump (not shown) mounts a carrier member 34, on which centrifugal weights 2 are pivotably disposed in a known manner. A sleeve 3 which is co-axial with the cam shaft 1 moves to the right in response to increasing rotational speed of the centrifugal weights 2. One end of sleeve 3 is connected to a shifter 4. The movement of the shifter 4 is transmitted to a pair of parallel guide levers 7 (only one shown) whose lower ends are pivoted thereto, and ultimately to a control rod 15 through a link 14, a floating lever 12, and a pivot pin 8 coupling the levers 7 and 12 together. The rod 15 controls the fuel supply quantity of a fuel injection pump. Movement to the right decreases the fuel supply, and vice versa. The upper ends of the guide levers 7 are rotatably secured to a pivot pin 6 mounted on a cover or housing 5. A tension lever 9 is pivotally mounted on the pin 6 between the guide levers 7, and rotates independently of the guide levers. A stop member 10 is provided on the housing 5 adjacent the lower end of the tension lever 9 to limit or restrict its clock-wise rotation about the pin 6. At an intermediate portion of the tension lever 9 a first integral spring eye 35 is provided, to which one end of a main spring 11 is connected. The upper end of the floating lever 12 is connected to one end of a start spring 13, the other end of which is attached to the housing 5. The control rod 15 is connected, via a link 14, to the lever 12 a short distance below its upper end. The lower end of the floating lever 12 is rotatably secured to a pivot pin 16 brazed to a fork 17 mounted on the housing 5. The other end of the main spring 11 is attached to a swivel arm 19, which is integral with a speed control lever 18 on the outside of the housing. The initial tension of the main spring 11 can be adjusted by a screw member 20. The speed control lever 18 is connected to an accelerator arm or pedal in a conventional manner. The maximum counterclockwise rotation of the control lever 18 is limited by a bolt 21 provided on the housing 5.

One end of a torque spring 22 is attached to a second spring eye 28 on the lower portion of the tension lever 9. The other end of the torque spring 22 is connected to a tension rod 25, the opposite surfaces of which are flattened to prevent its rotation. The tension rod 25 is slidably mounted in a bush 24 disposed in an extension housing 23. The tension rod 25 has a nut 26 which functions as a stopper when the rod 25 slides to the extreme left, whereat the nut abuts the bush 24 and the torque spring 22 begins to tension. The nut 26 controls the position at which the torque spring 22 begins to function, i.e. become tensioned and exert a force on the lever 9 opposed to the force of the main spring 11. This produces the sharp dropoff between points B and C in the curve of FIG. 3.

In operation, in response to an increased rotational speed of the engine, the centrifugal weights 2 driven by the cam shaft 1 of the injection pump open or move radially outwardly to thereby slide the sleeve 3 to the right. This movement is transmitted to the tension lever 9 and guide levers 7 through the shifter 4, to thereby rotate the levers about the pin 6 in a counter-clockwise direction until the centrifugal force of the weights 2 reaches a balanced equilibrium with the tension of the main spring 11. The rotational movement of the guide levers 7 causes the floating lever 12 to rotate in a clockwise direction about its pivot pin 16, whereby the link 14 and the control rod 15 move to the right to decrease the fuel supply.

If the rotational speed of the engine decreases due to an increased load, the main spring 11 causes the tension lever 9 to push the shifter 4 to the left. This moves the control rod 15 to the left, via the guide levers 7, the floating lever 12 and the link 14, to thereby increase the fuel supply.

Figure 3:
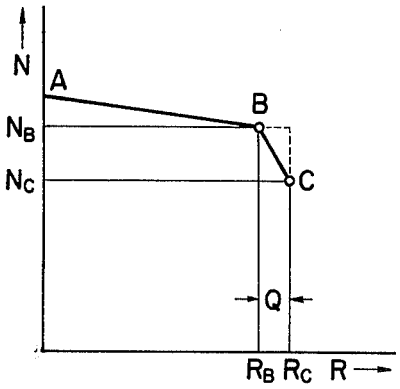
FIG. 3 shows a characteristic control curve illustrating the relationship between the engine rotation speed N and the position of a fuel supply control rod R.

When the control rod 15 is in a maximum engine output position, $R_B$ in FIG. 3, the nut 26 is brought into contact with the bush 24 and the torque spring 22 begins to exert tension. This condition corresponds to point B in FIG. 3. Therefore, the further movement of the control rod 15 from $R_B$ to $R_C$ is restricted by the added tension of the torque spring 22, which causes the sharp, operator alerting speed reduction from $N_B$ to $N_C$. This action is referred to in the art as torque control.

There are several disadvantages, however, in the above-described conventional torque control mechanism. For one thing, since the torque spring 22 is directly and permanently connected to the tension lever 9, it always affects the movement thereof, even during partial load operations of the engine when it is unnecessary to provide a sharp, warning speed reduction. Another disadvantage is that since minute displacements of the torque spring are magnifyingly transmitted to the control rod 15, the dimensional accuracy of the torque spring is very critical and costly to achieve. Finally, such a conventional mechanism requires a large additional space to accomodate it, to wit the extension housing 23.

Figure 2:
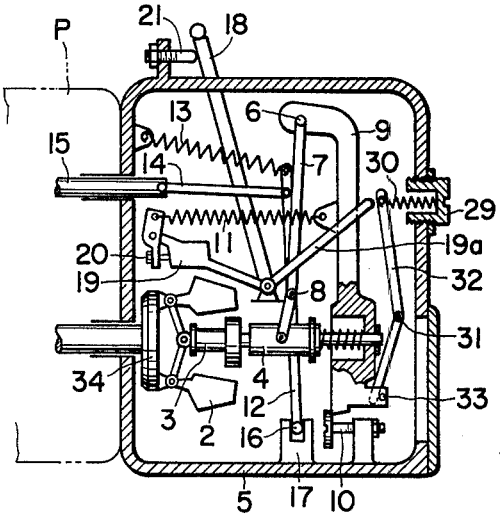
FIG. 2 is a schematic sectional view of a centrifugal type mechanical governor mechanism employing a torque control device according to the present invention.

FIG. 2 shows an embodiment of the present invention, in which the structural elements designated by the same reference numerals used in FIG. 1 cooperate and function in the same manner as described above. In the present invention, a torque lever 32 is rotatably secured to a fixed pin 31. The length of the upper portion of the lever 32, above the pin 31, is longer than that of its lower portion. Said lower portion is proximate to and may be loosely engaged with a transverse stop pin 33 fixed to the lower rear portion of the torque lever 32. The upper rear portion of the torque lever 32 is compressively connected to one end of a torque spring 30, whose other end is connected to an adjusting screw 29 threaded into the housing 5.

An extension arm **19*a* is integral with or rigidly secured to the control lever 18 and/or the swivel arm 19. The extension arm 19*a* is arranged to engage the upper front portion of the torque lever 32 in a camming manner when the set speed of the engine, as determined by the position of the control lever 18, is below a predetermined value, whereby the torque spring 30 is compressed in a rightward direction. When the control lever 18 is shifted toward the idling position, for example (to the right in FIG. 2), the extension arm 19*a* engages and rotates the torque lever 32 in a clockwise direction, which moves the lower end of the torque lever away from and out of engagement with the stop pin 33. Under these conditions the torque control function is disabled, and the movement of the tension lever 9** is not in any way affected or restricted by the torque control mechanism.

When the control lever 18 is in the full load or full speed position, however, as shown in FIG. 2, the extension arm **19*a* becomes disengaged from the torque lever 32, whereby the torque spring 30 rotates the lever in a counter-clockwise direction to bring the lower end of the lever closer to (and in possible contact with-depending on the engine speed) the stop pin 33**. Under these conditions the torque control function is fully enabled, and the force of the torque spring opposes or subtracts from that of the main spring when the engine slows down under excessive load, thereby providing the desired additional speed reduction warning.

Figure 4:
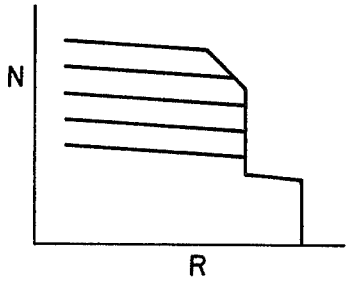
FIG. 4 shows a graph illustrating the relationship between the rotation speed N and the position of the fuel supply control rod R in partial load and full load conditions according to the present invention.
Figure 5:
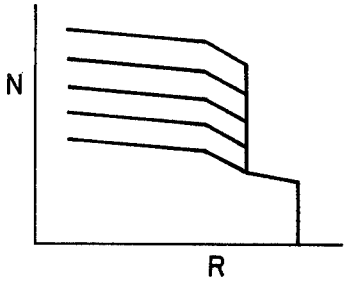
FIG. 5 PRIOR ART
FIG. 5 shows a graph illustrating the relationship between the rotation speed N and the position of the fuel supply control rod R in partial load and full load conditions according to a conventional mechanical governor.

FIGS. 4 and 5 show plots of engine rotation speed N versus the control rod position R according to the torque control mechanism of the present invention and the conventional torque control mechanism, respectively, for various speed control settings. In FIG. 4, during lower speed, partial load operations the sharp declines in the output curve are eliminated, whereas in FIG. 5 such declines are present at all speed settings.

Further, with the arrangement disclosed the mechanically transmitted displacements of the torque spring 29 are reduced instead of being magnified, which facilitates the simple adjustment of the torque spring. In addition, the torque control mechanism of the present invention is very compact and can easily be accomodated within a conventional governor housing.

What is claimed is:

1. In a mechanical governor for an internal combustion engine including centrifugal expansion means driven by the engine, a shifter axially movable by the expansion means in a first direction, a pivoted, spring biased tension lever for urging the shifter in a second, opposite direction, speed control means for adjusting the spring tension, a fuel supply control rod, and mechanical linkage means coupling the control rod to the shifter for movement therewith, an improved torque control mechanism characterized by:

(a) a pivoted torque lever, (b) an adjustable torque spring, (c) stop means on the tension lever engagable with the torque lever, and (d) an extension arm rigidly secured to the speed control means for camming the torque lever against the torque spring and out of engagement with the stop means at partial speed settings, whereby the torque control mechanism is disengaged from the governor and disabled at partial speed settings, but is released from the extension arm and acts against the tension lever biasing at full speed settings when the engine speed drops below a predetermined level.

2. A mechanical governor as defined in claim 1, wherein the torque lever is pivoted in its mid-portion, one end thereof engages the torque spring on one side and is engagable with the extension arm on the other side, and the other end thereof is proximate to and engageable with the stop means.

3. A mechanical governor as defined in claim 2, wherein the distance from the pivot point of the torque lever to the point of engagement thereof with the torque spring is greater than the distance from the pivot point to the point of engagement with the stop means.

* * * * *